US008367024B2

(12) United States Patent
Itoh

(10) Patent No.: US 8,367,024 B2
(45) Date of Patent: Feb. 5, 2013

(54) TEST TUBE HOLDER

(75) Inventor: Teruaki Itoh, Kumamoto (JP)

(73) Assignee: AOI Seiki Co., Ltd., Kumamoto-shi, Kumamoto-ken (JP)

( * ) Notice: Subject to any disclaimer, the term of this patent is extended or adjusted under 35 U.S.C. 154(b) by 374 days.

(21) Appl. No.: 12/697,768

(22) Filed: Feb. 1, 2010

(65) Prior Publication Data

US 2010/0226828 A1 Sep. 9, 2010

(30) Foreign Application Priority Data

Mar. 5, 2009 (JP) ..... 2009-052281

(51) Int. Cl.
*B01L 9/06* (2006.01)

(52) U.S. Cl. ..... 422/562; 422/560; 422/561; 206/443; 211/60.1

(58) Field of Classification Search ..... 422/560–562; 206/443; 211/60.1
See application file for complete search history.

(56) References Cited

U.S. PATENT DOCUMENTS

| | | | |
|---|---|---|---|
| 6,932,942 | B2 | 8/2005 | Itoh |
| 2003/0133848 | A1 | 7/2003 | Itoh |
| 2006/0222573 | A1 | 10/2006 | Itoh |

FOREIGN PATENT DOCUMENTS

| | | |
|---|---|---|
| JP | 11/505920 | 5/1999 |
| JP | 2000-9737 | 1/2000 |
| JP | 2003-211006 | 7/2003 |
| JP | 2006-281018 | 10/2006 |

OTHER PUBLICATIONS

Japanese Office Action and English language translation in JP 2009-052281dated Oct. 19, 2010.

*Primary Examiner* — In Suk Bullock
*Assistant Examiner* — Paul Hyun
(74) *Attorney, Agent, or Firm* — Nixon & Vanderhye P.C.

(57) ABSTRACT

According to an example of the invention, a test tube holder includes a holder body including a cylindrical wall defining a cylindrical hollow portion, at least three guide grooves in the cylindrical wall and open on the inner peripheral side and upper end surface side, cam grooves which face the guide grooves and inclined obliquely upward, a plurality of holder members for test tube attachment which are fitted individually in the guide grooves of the holder body so as to be movable vertically and radially, cam pins which engage with the cam grooves so as to guide the holder member vertically and radially, and an urging spring which elastically urges the holder member to be pushed up so that the holder member is pressed upward and toward the inner periphery of the cylindrical wall.

4 Claims, 3 Drawing Sheets

TEST TUBE HOLDER

CROSS-REFERENCE TO RELATED APPLICATIONS

This application is based upon and claims the benefit of priority from prior Japanese Patent Application No. 2009-052281, filed Mar. 5, 2009, the entire contents of which are incorporated herein by reference.

BACKGROUND OF THE INVENTION

1. Field of the Invention

The present invention relates to a test tube holder used in conveying a test tube containing a specimen such as blood.

2. Description of the Related Art

A test tube containing a specimen such as blood is a transparent glass or plastic tube fitted with a rubber or plastic cap on its top opening. In order to convey the specimen in the test tube to each of processing sections for aliquoting or dispensing, the test tube is held vertically in a test tube holder that is guided along a conveying path.

To this end, the test tube holder is configured to hold and convey any of various test tubes having different lengths and diameters in a stable vertical position. Specifically, an engagement portion formed of an annular groove, which is engageable with a guide rail of a conveying system, is disposed on the outer peripheral surface of a proximal end portion of a base that constitutes a holder body. Further, a cylindrical hollow portion that accommodates a test tube is formed to a predetermined depth along the axis of the base so as to extend from its distal end toward proximal end. In some known test tube holders, moreover, a test tube adapter portion that can alternatively hold test tubes having different outside diameters is disposed in a cylindrical hollow portion of a holder body (e.g., Jpn. Pat. Appln. KOKAI Publications Nos. 2003-211006 and 2006-281018).

In the test tube holder described in Jpn. Pat. Appln. KOKAI Publication No. 2003-211006, however, leaf springs disposed in the cylindrical hollow portion of the holder body include contact portions, which are configured to contact the outer peripheral surface of a test tube to be held. Further, this test tube holder is provided with a single O-ring, which binds the leaf springs so as to surround them in order to press the contact portions of the adapter portion against the outer peripheral surface of the test tube at a given pressure.

Thus, the leaf springs have complex structures and their elasticity is compensated for by the single O-ring. Consequently, poor assemblability increases cost, and the O-ring involves troublesome maintenance if it is damaged.

In the test tube holder described in Jpn. Pat. Appln. KOKAI Publication No. 2006-281018, moreover, a holder unit is formed of a holder spring, which includes a plurality of wires of a predetermined length arranged in a circular ring. The distal end portion of the holder spring projects upward from the holder body to form a test tube holder portion, which is elastic radially relative to the cylindrical hollow portion.

Thus, the test tube cannot be stably held vertically, and the structure of the holder unit is so complex that its assemblability is poor, which increases its cost.

BRIEF SUMMARY OF THE INVENTION

According to an example of the invention, a test tube holder includes a holder body including a cylindrical wall defining a cylindrical hollow portion which accommodates a test tube, at least three guide grooves which are arranged at regular circumferential intervals in the cylindrical wall of the holder body and open on the inner peripheral side and upper end surface side of the cylindrical wall, cam grooves located opposite one another in those surfaces of the cylindrical wall which face the guide grooves and inclined obliquely upward, extending from an outer peripheral portion of the cylindrical wall toward an inner peripheral portion thereof, a plurality of holder members for test tube attachment which are fitted individually in the guide grooves of the holder body so as to be movable vertically and radially and are configured to hold each of a plurality of types of test tubes having different outside diameters to be mounted in the cylindrical hollow portion, cam pins which are provided on opposite side portions of each the holder member and engage with the cam grooves so as to guide the holder member vertically and radially, and an urging spring which elastically urges each the holder member to be pushed up so that the holder member is pressed upward and toward the inner periphery of the cylindrical wall.

According to another aspect of the invention, the cam grooves in the cylindrical wall are two parallel grooves vertically spaced apart from each other, and the cam pins on each the holder member are two pins vertically spaced apart from each other and configured to engage independently with cam grooves.

According to another aspect of the invention, the holder members are radially movable toward and away from the center of the cylindrical hollow portion so that the holder members advance toward the center of the hollow portion in holding a small-diameter test tube and recede from the center of the hollow portion in holding a large-diameter test tube.

According to another aspect of the invention, the urging spring is a coil spring interposed between respective bottom portions of each the cam groove and the holder member corresponding thereto and configured to urge the holder member upward with respect to the cylindrical wall and toward the center of the cylindrical hollow portion.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
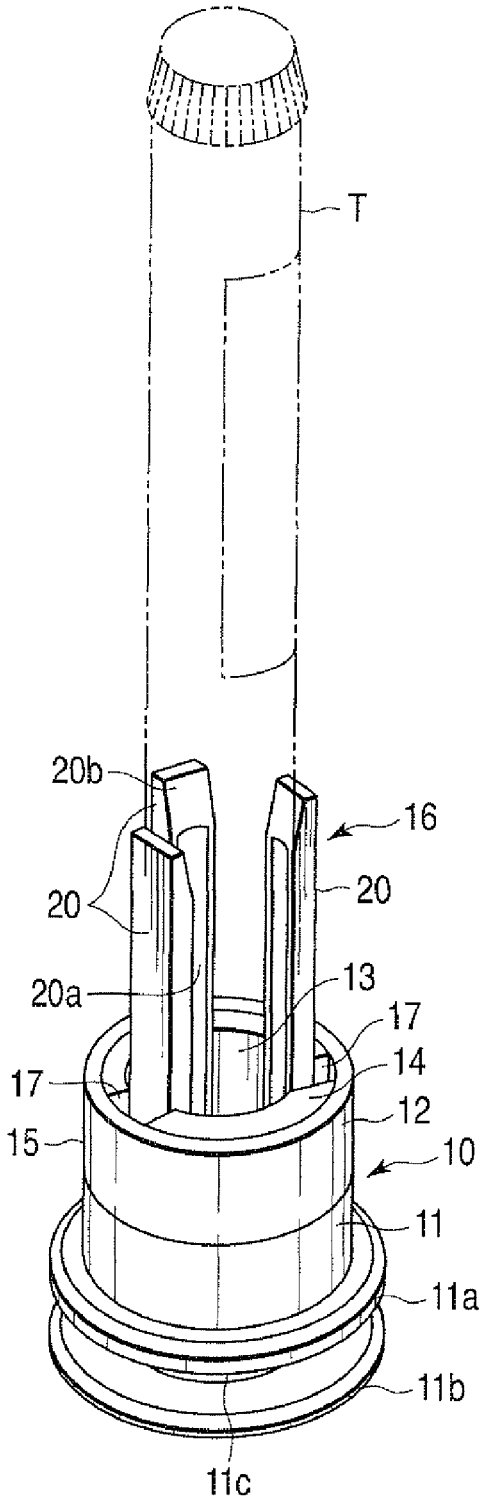
FIG. 1 is a perspective view of a test tube holder according to a first embodiment of the invention.

As shown in FIGS. 1 to 4, a test tube holder, which is used in conveying a test tube that contains a specimen such as blood, includes a holder body 10 molded from, for example, plastic material. Test tube holders can be used to store test tubes that contain blood or some other specimens or in conveying the test tubes by means of a conveyor and aliquoting, dispensing, and processing the specimens. The holder body 10 is formed of a cylindrical lower base 11 and cylindrical upper base 12, which is a little smaller in diameter than the lower base. The lower and upper bases 11 and 12 are coupled integrally with each other. The lower base 11 has, on its outer peripheral surface, an engagement portion that can engage with a conveyor rail. Specifically, the lower base 11 is provided with upper and lower flange portions 11*a* and 11*b*, between which an annular groove 11*c* is defined.

A cylindrical hollow portion 13 that accommodates the test tube opens extending along the axis of the upper base 12 from its upper end portion to the upper surface portion of the lower base 11. Thus, the upper base 12 is provided with a cylindrical wall 14 that surrounds the cylindrical hollow portion 13. Further, a metal ring 15 is fitted on the outer periphery of the cylindrical wall 14. The metal ring 15 doubles as an indicator whose presence can be detected by a photosensor or the like.

A holder portion 16 for test tube attachment is disposed within the cylindrical hollow portion 13. The holder portion 16 can hold each of a plurality of types of transparent glass or plastic test tubes T having different outside diameters and lengths. A specimen such as blood is contained in each test tube T.

Figure 2A:
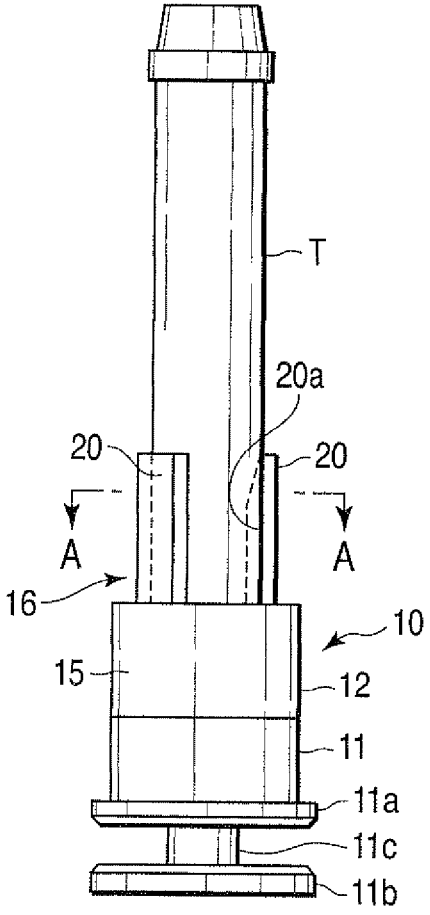
FIG. 2A is a side view showing the test tube holder of the first embodiment.
Figure 2C:
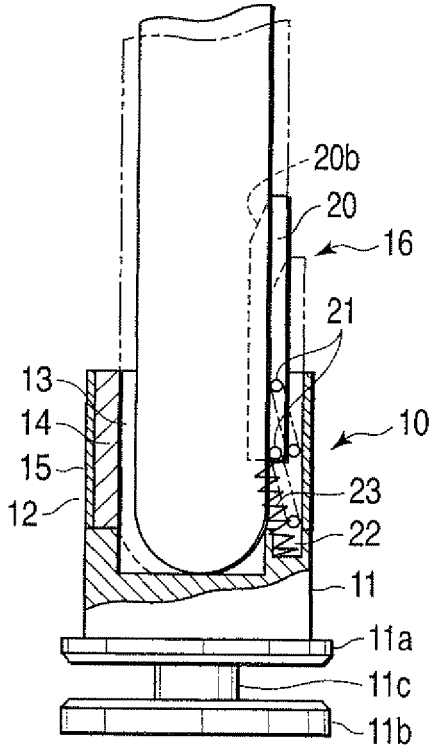
FIG. 2C is a side view of the test tube holder of the first embodiment with its holder body shown partially in section.
Figure 2B:
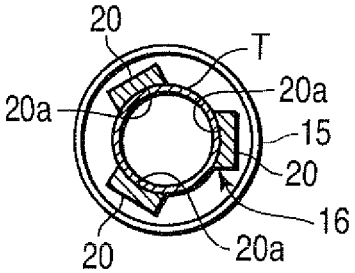
FIG. 2B is a sectional view of the test tube holder of the first embodiment taken along line A-A of FIG. 2A.
Figure 3A:
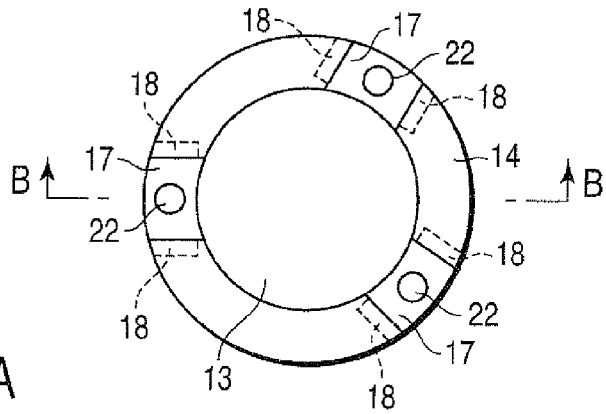
FIG. 3A is a plan view showing the holder body of the first embodiment with holder members removed.
Figure 3B:
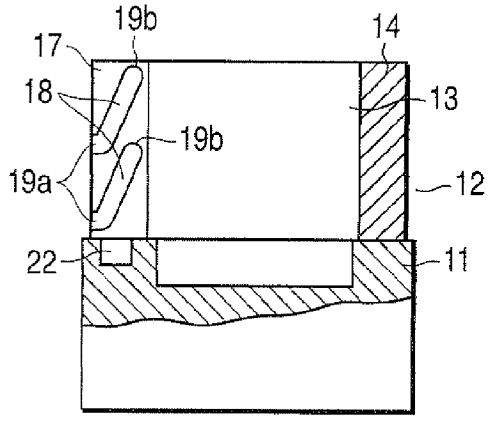
FIG. 3B is a sectional view taken along line B-B of FIG. 3A.

The following is a description of the holder portion 16. As shown in FIGS. 2 and 3, the cylindrical well 14 is provided with guide grooves 17 that are arranged at regular circumferential intervals (of 120° in the present embodiment). These guide grooves 17 are flutes that open on the inner peripheral and upper end surface sides of the cylindrical wall 14 and are recessed radially with respect to the center of the cylindrical hollow portion 13. Those opposite surfaces of the cylindrical wall 14 which face each guide groove 17 are provided with cam grooves 18, which are inclined obliquely upward, extending from the outer peripheral portion of the cylindrical wall 14 toward the inner peripheral portion.

The cam grooves 18 extend in two parallel rows vertically spaced apart from each other. An opening part 19*a* of each cam groove 18 is disposed on the outer peripheral side of the cylindrical wall 14, and a closed part 19*b* on the inner peripheral side. A holder member 20 that forms the holder portion 16 is fitted in each guide groove 17 so as to be movable vertically and radially. The holder member 20 is a square bar having a substantially rectangular cross section, which, like the holder body 10, is molded from plastic material. The holder member 20 is a little narrower than each guide groove 17 and substantially as thick, as the cylindrical wall 14. An arcuate recess 20*a* is formed in the inner surface of holder member 20, and a slope 20*b* at the upper end portion of the inner surface. The arcuate recess 20*a* can be in planar contact with the sidewall of any of a plurality of types of test tubes T having different outside diameters. The slope 20*b* serves to guide the test tube T.

Figure 4:
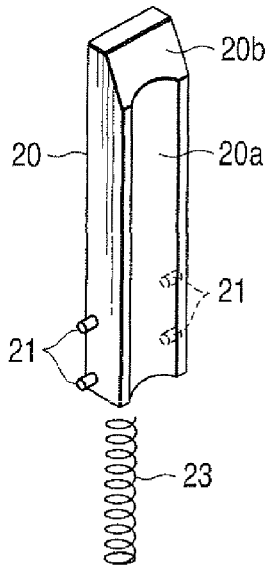
FIG. 4 is a perspective view showing a holder member and coil spring of the first embodiment.

As shown in FIG. 4, two cam pins 21 protrude from each side portion of the holder member 20. The cam bins 21 engage with their corresponding cam groove 18 so as to guide the holder member 20 vertically and radially. Specifically, the cam pins 21 can be inserted into the cam groove 18 through its opening part 19*a* so that they slide within the cam groove 18, thereby keeping the holder member 20 vertical.

Further, a spring retainer hole 22 is formed in the upper end surface of the lower base 11 at the bottom of each guide groove 17. The lower end portion of a coil spring 23 as an urging spring is fitted in the retainer hole 22. The upper end portion of the coil spring 23 abuts the lower end surface of the holder member 20 so that the holder member 20 is elastically urged to be pushed up by the spring 23. Thus, the holder member 20 is elastically pressed upward and toward the inner periphery of the cylindrical wall 14, so that the cam pins 21 are pressed against the closed part 19*b* of each cam groove 18.

According to the test tube holder constructed in this manner, the holder body 10 includes the cylindrical hollow portion 13 that accommodates the test tube, and the holder portion 16 for test tube attachment can hold each of a plurality of types of test tubes T having different outside diameters and lengths. The holder portion 16 is designed so that the three holder members 20 mounted in the cylindrical hollow portion 13 of the holder body 10 are elastically pressed upward and toward the inner periphery of the cylindrical wall 14 by their corresponding coil springs 23. The cam pins 21 are pressed against the closed part 19*b* of each cam groove 18.

Thus, if the test tube T is inserted into the cylindrical hollow portion 13, which is surrounded by the three holder members 20, from above the holder portion 16, it is guided along the respective slopes 20*b* of the holder members 20 to be held by the arcuate recesses 20*a*. If the outside diameter of the test tube T is small, when this is done, the holder members 20 advance toward the center of the hollow portion 13 and hold the test tube T vertically (indicated by solid line in FIG. 2C). If the outside diameter of the test tube T is large, the holder members 20 recede from the center of the hollow portion 13 and hold the test tube T vertically (indicated by two-dot chain line in FIG. 2C). Since the holder members 20 are elastically pressed upward and toward the inner periphery of the cylindrical wall 14 by the coil springs 23, moreover, the test tube T is elastically held by the holder members 20. Even though the test tubes T vary in outside diameter and length, therefore, the trunk of each test tube T can be securely grasped, so that a plurality of types of test tubes T having different outside diameters and lengths can be held by means of a single type of test tube holder. In addition, the test tube holder requires only few components and simple assembly work, so that its cost can be reduced. Thus, the test tube holder can stably hold each of a plurality of types of test tubes having different outside diameters vertically, and its simple structure leads to improvement in assemblability and durability.

Although the three holder members 20 are arranged at regular circumferential intervals with respect to the cylindrical hollow portion 13 according to the embodiment described above, the number of holder members 20 may alternatively be four or more.

The present invention is not limited directly to the embodiment described above, and its components may be embodied in modified forms without departing from the scope or spirit of the invention. Further, various inventions may be made by suitably combining a plurality of components described in connection with the foregoing embodiment. For example, some of the components according to the foregoing embodiments may be omitted. Furthermore, components according to different embodiments may be combined as required.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. A test tube holder comprising:

a holder body including a cylindrical wall defining a cylindrical hollow portion which accommodates a test tube;

at least three guide grooves which are arranged at regular circumferential intervals in the cylindrical wall of the holder body and open on the inner peripheral side and upper end surface side of the cylindrical wall;

cam grooves located opposite one another in those surfaces of the cylindrical wall which face the guide grooves and inclined obliquely upward, extending from an outer peripheral portion of the cylindrical wall toward an inner peripheral portion thereof;

a plurality of holder members for test tube attachment which are fitted individually in the guide grooves of the holder body so as to be movable vertically and radially and are configured to hold each of a plurality of types of test tubes having different outside diameters to be mounted in the cylindrical hollow portion;

cam pins which are provided on opposite side portions of each said holder member and engage with the cam grooves so as to guide the holder member vertically and radially; and an urging spring which elastically urges each said holder member to be pushed up so that the holder member is pressed upward and toward the inner periphery of the cylindrical wall.

2. A test tube holder according to claim 1, wherein the cam grooves in the cylindrical wall are two parallel grooves vertically spaced apart from each other, and the cam pins on each said holder member are two pins vertically spaced apart from each other and configured to engage independently with the cam grooves.

3. A test tube holder according to claim 1, wherein the holder members are radially movable toward and away from the center of the cylindrical hollow portion so that the holder members advance toward the center of the hollow portion in holding a small-diameter test tube and recede from the center of the hollow portion in holding a large-diameter test tube.

4. A test tube holder according to claim 1, wherein the urging spring is a coil spring interposed between respective bottom portions of each said cam groove and the holder member corresponding thereto and configured to urge the holder member upward with respect to the cylindrical wall and toward the center of the cylindrical hollow portion.

* * * * *